US006433748B1

(12) United States Patent
Ekelund

(10) Patent No.: US 6,433,748 B1
(45) Date of Patent: Aug. 13, 2002

(54) ELASTIC ANTENNA ELEMENT

(75) Inventor: Per Ekelund, Billdal (SE)

(73) Assignee: Volvo Car Corporation (SE)

( * ) Notice: Subject to any disclaimer, the term of this patent is extended or adjusted under 35 U.S.C. 154(b) by 0 days.

(21) Appl. No.: 09/180,042

(22) Filed: Oct. 30, 1998

(30) Foreign Application Priority Data

Apr. 30, 1996 (SE) ..... 9601650

(51) Int. Cl.[7] ..... H01Q 1/32
(52) U.S. Cl. ..... 343/713
(58) Field of Search ..... 343/711, 712, 343/713; H01Q 1/32

(56) References Cited

U.S. PATENT DOCUMENTS

| | | | | |
|---|---|---|---|---|
| 1,829,219 A | | 10/1931 | Heina | 343/713 |
| 1,884,176 A | | 10/1932 | Pagel et al. | 343/713 |
| 2,073,336 A | * | 3/1937 | Cook | 343/713 |
| 2,774,811 A | * | 12/1956 | Shanok et al. | 343/713 |
| 3,634,864 A | * | 1/1972 | Trachtenberg | 343/713 |
| 3,794,997 A | * | 2/1974 | Iwatsuki et al. | 343/713 |
| 4,879,570 A | * | 11/1989 | Takizawa et al. | 343/713 |
| 5,355,142 A | * | 10/1994 | Marshall et al. | 343/700 MS |
| 5,457,467 A | | 10/1995 | Schenkyr et al. | 343/713 |
| 5,734,350 A | * | 3/1998 | Deming et al. | 343/700 MS |

FOREIGN PATENT DOCUMENTS

| | | |
|---|---|---|
| DE | 27 51 356 | 5/1979 |
| GB | 2 183 099 A | 5/1987 |

* cited by examiner

*Primary Examiner*—Michael C. Wimer
(74) *Attorney, Agent, or Firm*—Kilpatrick Stockton LLP

(57) ABSTRACT

The present invention relates to an antenna for the reception and/or transmission of radio signals in a vehicle. The antenna is arranged to be located in a deformable part (2) of the vehicle, and is made in the shape of an elastically, deformable antenna element (1).

10 Claims, 2 Drawing Sheets

ELASTIC ANTENNA ELEMENT

TECHNICAL FIELD

The present invention relates to apparatus for the transmission and/or reception of radio signals in a vehicle.

BACKGROUND OF THE INVENTION

There are a number of different possible locations for an antenna for the reception and transmission of radio signals in a vehicle. Antennas visibly arranged on the outside of the body are easily exposed to intentional or unintentional damage and climatic influences, which can cause contact problems and also corrosion problems in lead-through holes in the vehicle body. Various methods of giving the antenna a more protected location have for this reason been tried, for example in the bumper of the vehicle. An antenna located in this way is previously known from DE 2 751 356. This document shows an antenna of the ferrite rod kind, with induction coils with the antenna embedded in an elastic shock absorbing mass which fills the space, which normally to a large extent consists of cavities in the bumper. Although the shock absorbing mass to some degree protects the ferrite rod, this kind of antenna is very brittle and can easily be broken even in case of a minor collision, when for example parking. According to the present legislation, a bumper must be able to survive a deformation at low speeds and thus resume its initial shape and function, demands which are true for all the elements of the bumper such as built-in antenna elements.

SUMMARY OF THE INVENTION

The object of the present invention is to obtain an antenna which meets the demands on the deformable part of the vehicle in which the antenna is arranged.

Said object is achieved by means of an antenna according to the present invention. An antenna for transmitting and/or receiving radio signals in a vehicle according to one aspect of the present invention comprises a plate mounted within a part of the vehicle which is deformable in response to collision of the vehicle, the plate being elastically deformable so that the antenna regains its original form after collision of the vehicle. The plate may be shaped to bend during collision and regain its original form after collision of the vehicle. The plate preferably has the shape of an arch. A first end of the antenna may be attached to the body of the vehicle and may include a portion shaped to deform in response to deformation of the deformable part of the vehicle. The antenna may also include a second end positioned within the deformable part so that the second end moves towards the first end during collision of the vehicle. The antenna may comprise a pate of steel.

An antenna for transmitting and/or receiving radio signals in an vehicle in accordance with another aspect of the invention comprises a plate mounted within the bumper of the vehicle so that the plate is biased in a direction away from the body of the vehicle. The plate may be comprised of an elastically deformable material so that the antenna regains its original form after collision of the vehicle. The plate may have a first end attached to the body of the vehicle and a second end positioned within the bumper so that the plate is biased against collision of the vehicle.

DESCRIPTION OF THE DRAWINGS

The invention will in the following be described in greater detail by means of an example of an embodiment, with reference to the appended drawings in which FIG. 1 schematically shows a section of a vehicle with a bumper in which said antenna is arranged, FIG. 2 on a larger scale shows a cross-section through the bumper along the line II:II of FIG. 1, while

PREFERRED EMBODIMENT

Figure 1:
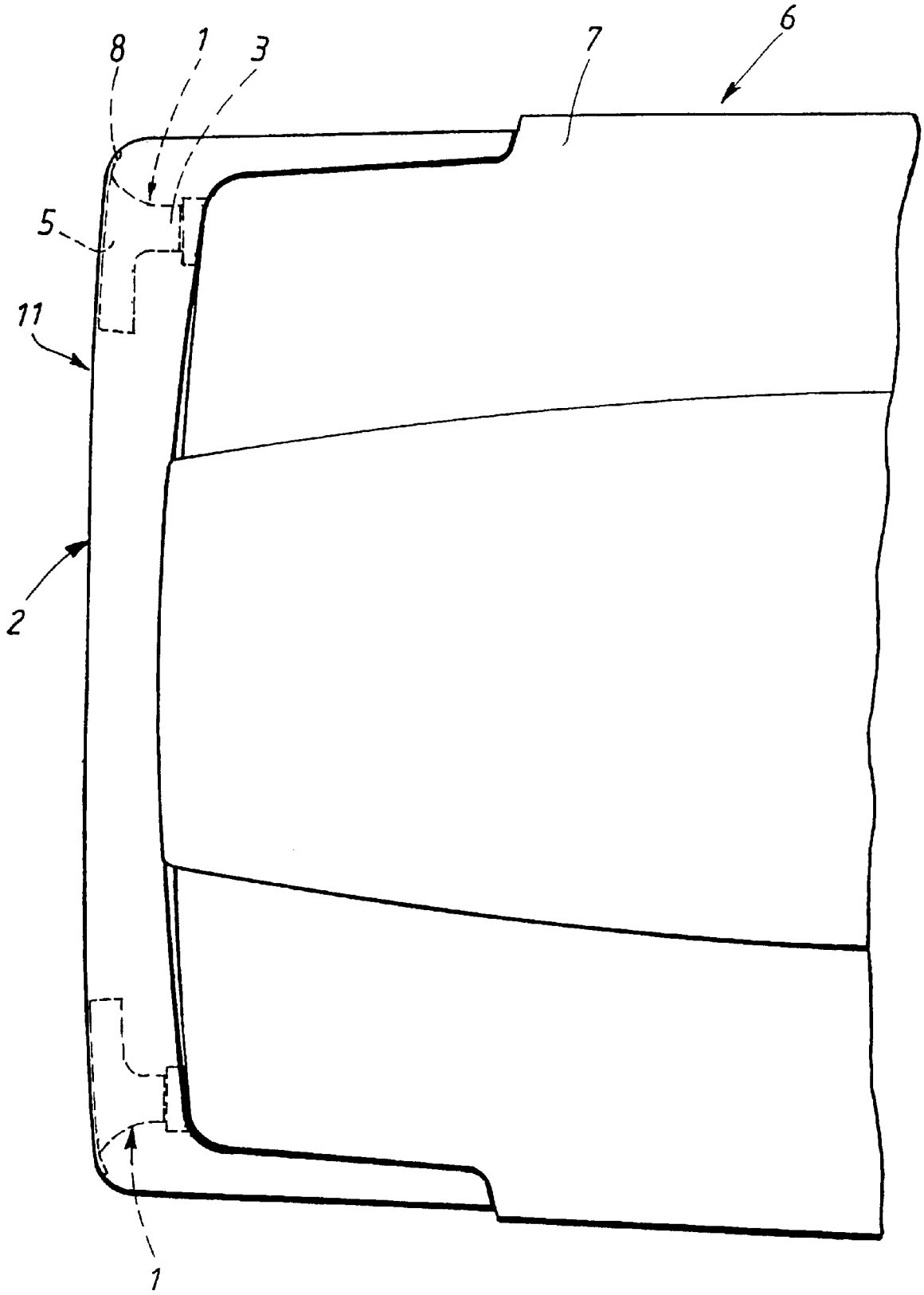

As can be seen from the drawings, the antenna according to the invention consists of an antenna element which has been shaped in a bent form, preferably from a plate-shaped material of suitable stiffness and electrically conducting properties, for example sheet metal. The material is suitably highly resilient, for example spring steel, stainless steel or the like so that the antenna element following a deformation can resume its initial shape. The antenna is intended to be arranged in a deformable part of the vehicle, to be more exact a part which is deformable in such a manner that it under certain conditions can resume its initial shape. In the shown example, the deformable part is a bumper 2 which, according to certain norms, following a deformation must be able to resume its initial shape in the case of collisions with speeds in the interval of 5–10 km/h. In the shown example, the antenna 1 consists of two antenna elements which are arranged at a suitably adjusted distance from each other in order to permit so-called diversity reception during radio reception. In the shown example, the antenna elements are arranged in the outer corners of the bumper in order to reduce the shielding properties of the body. The antenna elements can be placed either in the front or in the rear bumper or in both. A location at the opposite end relative to the location of the engine in the vehicle is however suitable due to interference.

Figure 2:
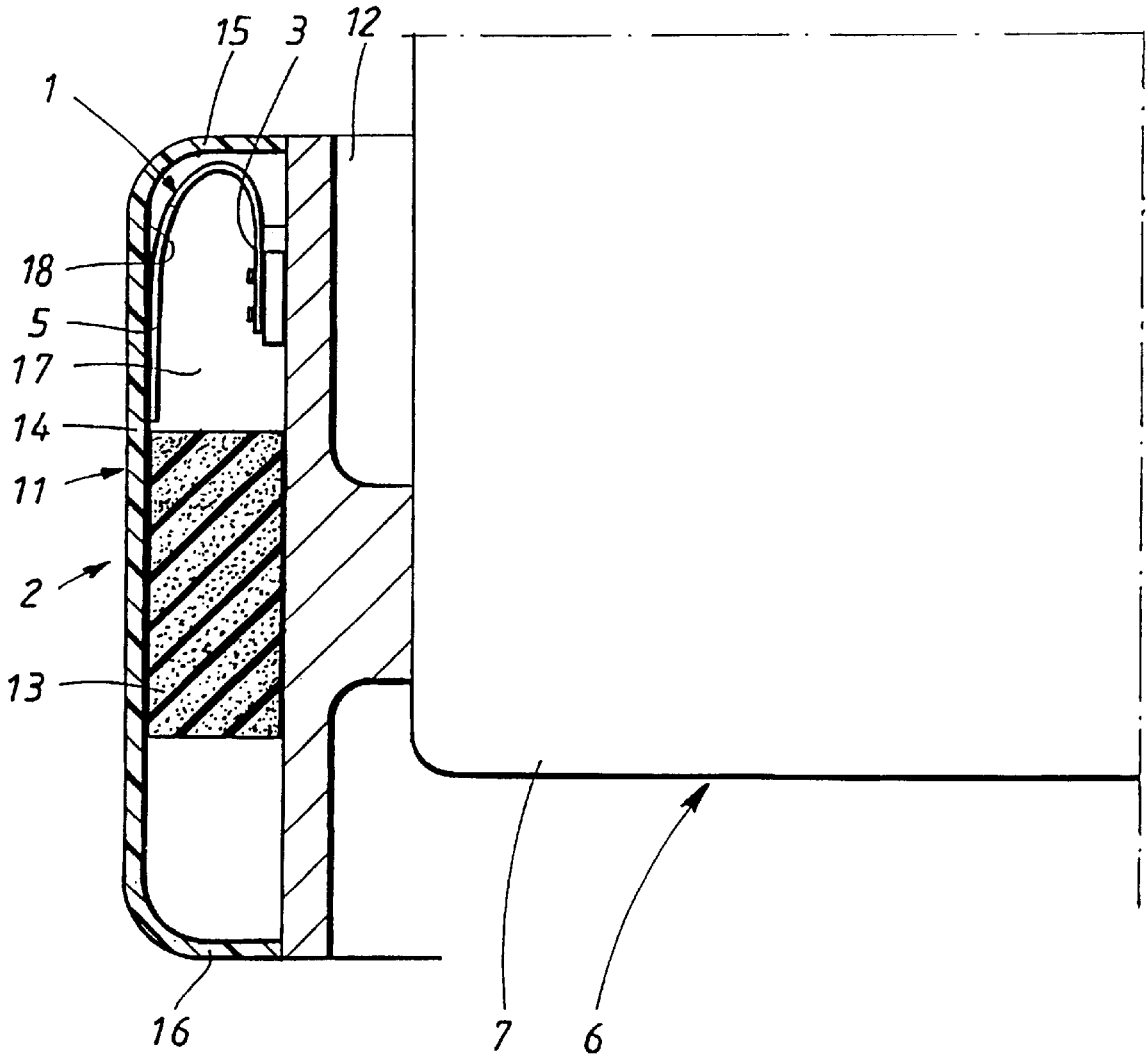
Figure 3:
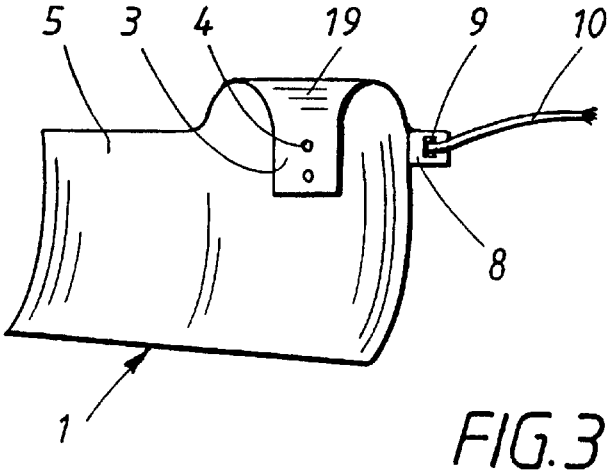
FIG. 3 shows only the antenna.

As can best be seen in FIGS. 2 and 3, the antenna element has an attachment part 3 which in its simplest form can be a tongue made of a piece of metal which is bent backwards and downwards, and which is provided with attachment holes 4 for attaching the antenna element with attachment elements, for example screws. One part of the piece of metal is the attachment part 3 and another part is an antenna part 5, which essentially can have for example a rectangular shape and be shaped in the same way as the external part of the bumper in order to be arranged as far away as possible from the ground plane which is defined by the body. The antenna element furthermore has a connection part 8, in the shown example in the shape of an ear with an attachment hole 9 for an antenna cable 10 which leads to a radio receiver.

FIG. 2 best shows an example of the arrangement of the antenna element in a bumper of a common kind. The bumper 2 has a shock absorbing shell 11, usually made from hard rubber or hard plastic which is arranged on an inner wall of the casing 12. In the casing there is arranged an absorbing element 13, usually of a relatively stiff foam material, which is however arranged to be compressed in the case of a collision but to subsequently expand to its initial shape together with the casing. The casing consists of a part 14 which faces outwards, i.e. forwards or backwards from the body, with an upper and a lower part 15, 16. The casing in this way delimits one or several cavities 17 in which the antenna element or the antenna elements are located. The antenna element is attached to the vehicle in a part of the bumper which is the closest to the body 7, e.g. in the casing 12, while the active antenna part 5 extends at a distance from the body in order to achieve the best possible antenna characteristics. In the shown example, the antenna extends in the shape of a reverse U or rather in the shape of a reverse J so that the antenna part 5 is turned convexly outwards from the vehicle and joins the inside 18 of the outwards facing part 14 of the body. The bend of the antenna element can possibly be such that it is somewhat biased toward the inside of the casing, in order to eliminate the risk of rattling due to inadequate contact. The biasing can also cause improved elastic characteristics. Due to the shape of the antenna element, there is formed between the attachment part 3 and the antenna part 5 a bent transition part 19 which in practice will form a large part of the spring location of the antenna element, although a certain elastic deformation can also take place in the antenna element 5.

Using a combination of suitable arrangement, shape and choice of materials, the antenna according to the invention can thus be given such properties that it can be deformed elastically in case of a deformation of e.g. the bumper and subsequently resume its initial shape and function up toga certain speed of collision which the bumper 2 is intended to survive. For this reason, the antenna is preferably essentially arranged in such a direction that its main elastic movement can take place in the most common direction of deformation, i.e. in the longitudinal direction of the vehicle. Preferably, the attachment is also arranged closest to the body,so that the antenna part 5 can be permitted to contract in the direction of, and expand in the direction from, the attachment point.

The invention is not limited to the above described and in the drawings shown examples of an embodiment but can be varied within the scope of the appended claims. For example, the antenna element can be made from a correspondingly bent wire. Furthermore the metal sheet can be replaced with electrically conducting plastic or be equipped with embedded metal wires. Furthermore, the arrangement of the antenna element can be such that the element is rotated 90° relative to the shown example. The bumper can also be of a kind in which the cavities are completely filled with a shock absorbing material, in which case the antenna element can be embedded in the material. The attachment part 3 can be shaped in many various ways, as can the attachment part 8 for the antenna cable and its location.

What is claimed is:

1. An antenna for transmitting and/or receiving radio signals in a vehicle having a body, comprising a plate mounted within a part of the vehicle which is deformable in response to collision of the vehicle, said plate being elastically deformable so that the antenna regains its original form after collision of the vehicle.

2. The antenna of claim 1, wherein said plate is shaped to bend during collision and regain its original form after collision of the vehicle.

3. The antenna of claim 1, wherein said plate has the shape of an arch.

4. The antenna of claim 1, wherein said antenna has a first end attached to said body of the vehicle.

5. The antenna of claim 4, wherein said antenna includes a portion shaped to deform in response to deformation of said deformable part of the vehicle.

6. The antenna of claim 5, wherein said antenna includes a second end positioned within said deformable part so that said second end moves toward said first end during collision of the vehicle.

7. The antenna of claim 1, wherein said antenna comprises a plate of steel.

8. An antenna for transmitting and/or receiving radio signals in a vehicle having a body, comprising a plate mounted within the bumper of the vehicle so that said plate is biased in a direction away from said body.

9. The antenna of claim 8, wherein said plate is comprised of an elastically deformable material so that the antenna regains its original form after collision of the vehicle.

10. The antenna of claim 8, wherein said plate has a first end attached to said body and a second end positioned within said bumper so that said plate is biased against collision of the vehicle.

* * * * *